US006648735B2

(12) United States Patent
Miyashita et al.

(10) Patent No.: US 6,648,735 B2
(45) Date of Patent: Nov. 18, 2003

(54) METHOD OF ABRADING BOTH FACES OF WORK PIECE

(75) Inventors: Tadakazu Miyashita, Nagano (JP); Tsuyoshi Hasegawa, Nagano (JP); Atsushi Kajikura, Nagano (JP); Norihiko Moriya, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 50 days.

(21) Appl. No.: 10/037,742

(22) Filed: Nov. 9, 2001

(65) Prior Publication Data

US 2002/0058465 A1 May 16, 2002

(30) Foreign Application Priority Data

Nov. 15, 2000 (JP) ..... 2000-348169

(51) Int. Cl.[7] ..... B24B 7/00

(52) U.S. Cl. ..... 451/41; 451/261; 451/262; 451/288

(58) Field of Search ..... 451/41, 261, 262–269, 451/285, 287, 288, 290, 340–343

(56) References Cited

U.S. PATENT DOCUMENTS

| | | | | |
|---|---|---|---|---|
| 4,742,651 A | | 5/1988 | Wittstock | |
| 5,099,614 A | * | 3/1992 | Arai et al. | 451/8 |
| 5,762,543 A | * | 6/1998 | Kasprzyk et al. | 451/262 |
| 5,957,763 A | * | 9/1999 | Anderson et al. | 451/262 |
| 5,980,366 A | * | 11/1999 | Waddle et al. | 451/262 |
| 6,113,490 A | * | 9/2000 | Hakomori | 451/288 |
| 6,210,259 B1 | * | 4/2001 | Malkin et al. | 451/166 |
| 6,280,304 B1 | | 8/2001 | Nakamura et al. | |

FOREIGN PATENT DOCUMENTS

| | | |
|---|---|---|
| GB | 2337014 | 11/1999 |
| GB | 2344545 | 6/2000 |
| JP | 10-294299 | 11/1998 |

* cited by examiner

*Primary Examiner*—Joseph J. Hail, III
*Assistant Examiner*—Anthony Ojini
(74) *Attorney, Agent, or Firm*—Jordan and Hamburg LLP

(57) ABSTRACT

Method for abrading a work piece with a fixed load including a first abrading process in which pressure of a cylinder chamber of a cylinder unit suspending an upper abrasive plate is adjusted in order to apply first pressure to the work piece via the upper abrasive plate without applying the full weight of the upper abrasive plate and a second abrading process in which the pressure of the cylinder chamber is readjusted in order to to apply second pressure which is higher than the first pressure to the work piece via the upper abrasive plate without applying the full weight of the upper abrasive plate.

11 Claims, 4 Drawing Sheets

METHOD OF ABRADING BOTH FACES OF WORK PIECE

FIELD OF THE INVENTION

The present invention relates to a method for abrading both faces of a work piece.

BACKGROUND OF THE INVENTION

A lapping machine is one type of abrasive machine for abrading thin work pieces, e.g., silicon wafers.

In the lapping machine, a carrier holding work pieces is sandwiched between an upper abrasive plate and a lower abrasive plate which are rotated in opposite directions. The carrier is driven by a sun gear and an internal gear so that the work pieces are rotated and moved along a circular orbit. With this action, both faces of the work pieces can be lapped by the abrasive plates. The upper abrasive plate is vertically moved by a rod of a cylinder unit. When abrasion is started, the upper abrasive plate is slightly suspended by the cylinder unit so as not to apply the full weight of the upper abrasive plate. Suddenly applying a great force to the work pieces can thus be prevented during an initial abrasion step. This is called "low pressure abrasion". After the initial abrasion step, the full weight of the upper abrasive plate is applied to lap and finish the work pieces.

A similar structure is employed in a polishing machine. In the polishing machine, polishing cloth is adhered on an abrasive face of each abrasive plate to polish both faces of the work pieces.

In the conventional abrasive machine, e.g., the lapping machine, the polishing machine, the full weight of the upper abrasive plate is applied during a main abrasion step.

By applying the full weight of the upper abrasive plate, deformation of the heavy upper abrasive plate can be prevented and both faces of the work pieces, e.g., silicon wafers for semiconductor devices, can be made highly flat.

In the case of lapping silicon wafers, for example, preferred pressure for lapping the wafers is 100–120 g/cm or 9.8–1 1.76×10 Pa. Therefore, in the case of applying the full weight of the upper abrasive plate, the weight and thickness of the upper abrasive plate must be limited.

However, the upper abrasive plate is gradually abraded and its weight is also varied. For example, the weight of the upper abrasive weight is reduced from 500 kg to 495–490 kg in a week.

Reducing the weight of the upper abrasive plate adversely influences abrasive rate so that the time for abrading the work pieces gradually increases. If the weight of the upper abrasive plate is varied, abrasive conditions must be changed every time, and quality of products are not fixed. Since the time for abrading the work pieces must be longer, working efficiency must be lower.

SUMMARY OF THE INVENTION

The present invention is solves the disadvantages of the conventional method.

An object of the present invention is to provide a method for abrading both faces of a work piece in which the work piece can be abraded with a fixed load.

To achieve the object, the present invention has the following components.

Namely, the method of the present invention is performed in an abrasive machine including:

a rotatable lower abrasive plate;

a rotatable upper abrasive plate being provided to face the lower abrasive plate to clamp the work piece with the lower abrasive plate; and a cylinder unit having a rod from which the upper abrasive plate is suspended, the cylinder unit moving the upper abrasive plate in a vertical direction.

Using these components, a method comprises:

a first abrading process in which pressure of a cylinder chamber of the cylinder unit is adjusted to apply a first pressure to the work piece via the upper abrasive plate without applying the full weight of the upper abrasive plate; and a second abrading process in which the pressure of the cylinder chamber is readjusted to apply a second pressure higher than the first pressure to the work piece via the upper abrasive plate without applying the full weight of the upper abrasive plate.

The method may further comprise a third abrading process in which the pressure of the cylinder chamber is readjusted to apply a third pressure lower than the second pressure to the work piece via the upper abrasive plate.

In the method, a reinforcing rib may be provided to an upper face of the upper abrasive plate to increase the rigidity thereof.

In the method, a holding disk may be fixed to the rod of the cylinder unit, a plurality of connecting rods may be provided to the holding disk, and the upper abrasive plate may be fixed to the connecting rods.

By employing the reinforced upper abrasive plate or holding the upper abrasive plate with the connecting rods, the deformation of the upper abrasive plate, which is caused by its own weight, can be prevented even if the upper abrasive plate is always suspended for the "low pressure abrasion". Therefore, both faces of the work piece can be made highly flat.

A heavy and thick upper abrasive plate may be used to increase the rigidity thereof. In this case, the "low pressure abrasion" is performed so a fixed load or pressure can be applied.

Further, in the method, the first abrading process and the second abrading process may be performed by:

calculating the constant "A", on the basis of: a formula "$W=-A\cdot P+B$" (B: the weight of the upper abrasive plate, P: the total pressure of the cylinder chamber of the cylinder unit, A: a proportional constant relating to frictional loss, etc., W: actual load applied from the upper abrasive plate); the known weight "B1" of the upper abrasive plate; the measured actual load "W1" applied from the upper abrasive plate when an optional load is applied to the upper abrasive plate; and the measured total pressure "P1" of the cylinder chamber;

calculating a value "P2" which satisfies a formula "$W2=-A\cdot P2+B1$" (W2: the set actual load applied from the upper abrasive plate while abrading);

monitoring the pressure in the cylinder chamber; and adjusting the total pressure in the cylinder chamber to the value "P2", and the first abrading process and the second abrading process of the subsequent time in which another work piece is abraded a prescribed amount may be performed by:

calculating the value "B1" ($=A\,P_x$) of a balanced state on the basis of the value "W" (=0) and the measured total pressure "$P_x$" of the cylinder chamber;

replacing the value "B1" with the value "$P_x$"; and calculating a value "P3" which satisfies a formula of "W3=−A·P3+B1" (W3: the set actual load applied from the upper abrasive plate while abrading);

monitoring the pressure in the cylinder chamber; and adjusting the total pressure in the cylinder-chamber to the value "P3". In this case, the fixed pressure can be easily set every time by simple calculation so the work pieces can be uniformly abraded every time.

In the method of the present invention, the "low pressure abrasion" can be performed throughout the abrasion so abrasion of the upper abrasive plate does not adversely influence the quality of products. Further, the fixed pressure can be always applied so that the work pieces can be uniformly abraded every time. The abrading conditions can be easily set.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
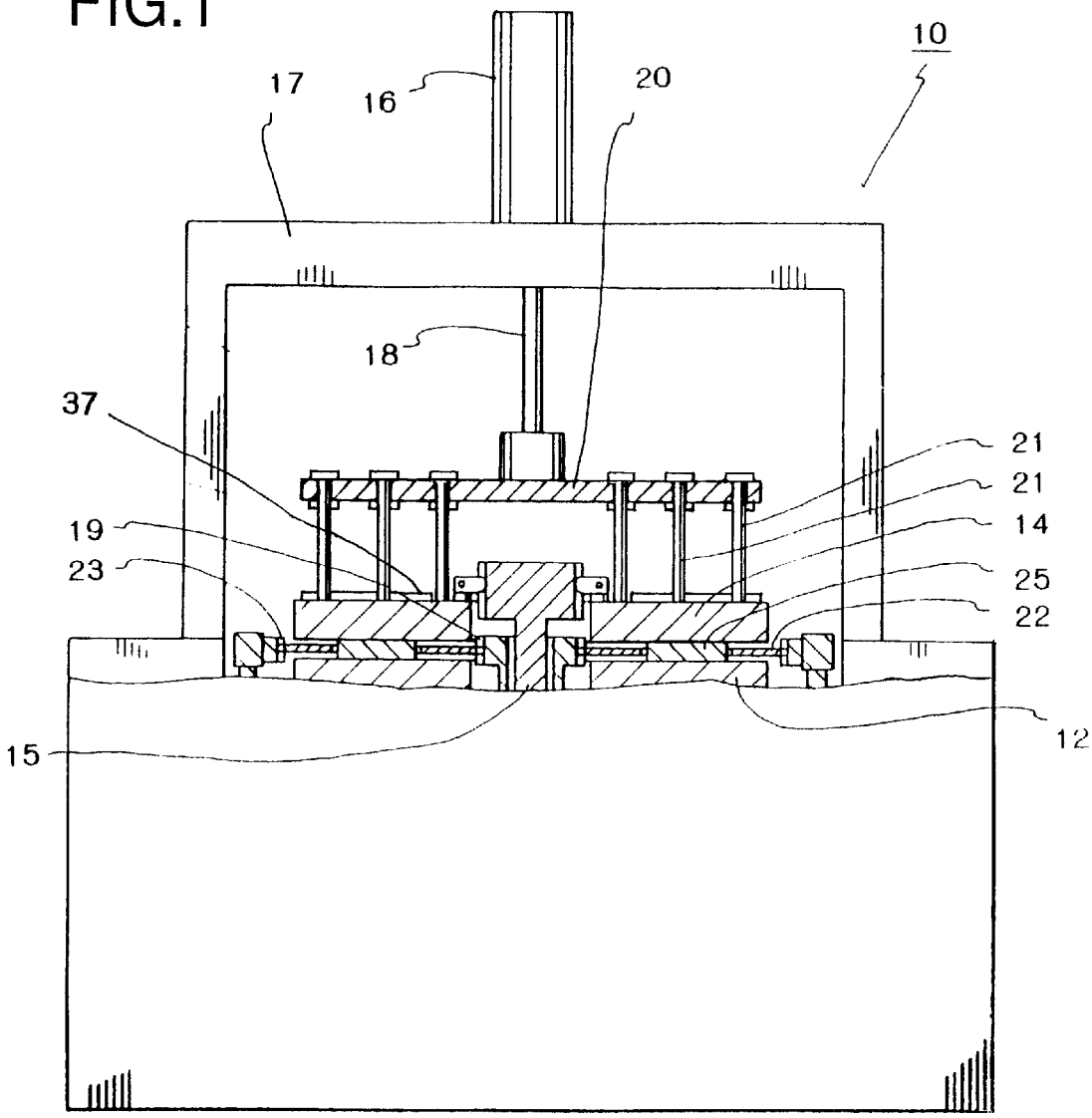
FIG. 1 is a partially cutaway view of a lapping machine in accordance with the invention.

An example of an abrasive machine capable of performing the method of the present invention will be explained with reference to FIGS. 1, and 2.

The abrasive machine 10 is a lapping machine capable of abrading both faces of silicon wafers. The method of the present invention can also be applied to polishing machines.

A lower abrasive plate 12 is rotated in a horizontal plane by a known driving mechanism (not shown).

An upper abrasive plate 14 is provided to face the lower abrasive plate 12. The upper abrasive plate 14 can be moved in the vertical direction. By engaging an engaging claw with a gear formed at an upper end of a rotary shaft 15, the upper abrasive plate 14 can be rotated. A rotational direction of the lower abrasive plate 12 is different from that of the upper abrasive plate 14.

A cylinder unit 16 is held by a gate-shaped frame 17. A rod 18 of the cylinder unit 16 is extended in the frame 17, and a holding disk 20 is fixed to a lower end of the rod 18. A size of the holding disk 20 is almost equal to that of the upper abrasive plate 14. A plurality of connecting rods 21 are fixed to the holding disk 20. The upper abrasive plate 14 is fixed to lower ends of the connecting rods 21. As shown in FIG. 2, the connecting rods 21 are uniformly distributed in the holding disk 20.

The upper abrasive plate 14 is connected to the rod 18 by a plurality of the connecting rods 21 and the holding disk 20, and the upper abrasive plate 14 is fixed to the connecting rods 21, which are uniformly arranged. With this structure, the upper abrasive plate 14 is suspended by the rod 18 without deformation.

Since the upper abrasive plate 14 can be suspended without deformation, the "low pressure abrasion" relating to the present invention can be performed.

A carrier 22 is provided on the lower abrasive plate 12 and engaged with a sun gear 19 and an internal gear 23. The sun gear 19 and the internal gear 23 are rotated by a known driving mechanism (not shown), so that the carrier 22 is rotated and moved like a planet on the lower abrasive plate 12.

A plurality of holes are formed in the carrier 22. Work pieces 25 are respectively provided and held in the holes. Therefore, the work pieces 25 are rotated and moved, on the lower abrasive plate 12, along a circular orbit.

Figure 3:
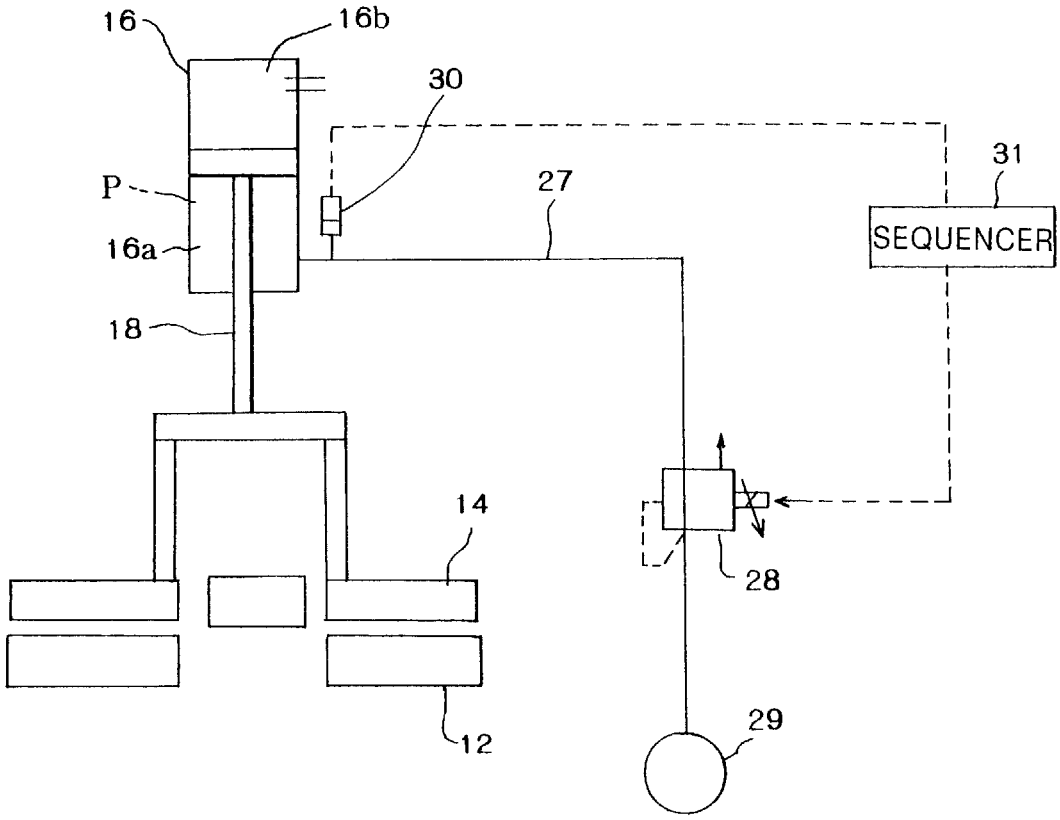
FIG. 3 is a schematic view of a pressure control mechanism of a cylinder unit.

A pressure control mechanism of the cylinder unit 16 is shown in FIG. 3.

A lower chamber 16*a* of the cylinder unit 16 communicates with an air pressure source 29 via a pipe 27 and a pressure control valve 28; an upper chamber 16*b* communicates with the surrounding atmosphere.

A pressure sensor 30 is connected to the pipe 27, and its connecting point is close to the lower chamber 16*a*. Pressure in the lower chamber 16*a* is measured by the pressure sensor 30, and the measured data is sent to a sequencer 31. The sequencer 31 controls the degree of opening of the control valve 28 on the basis of the data.

The upper chamber 16*b* may communicate with the air pressure source 29 in order to introduce and discharge air. In this case, "pressure of the cylinder chamber" (described later) means a pressure difference between the chambers 16*a* and 16*b*.

Figure 4:
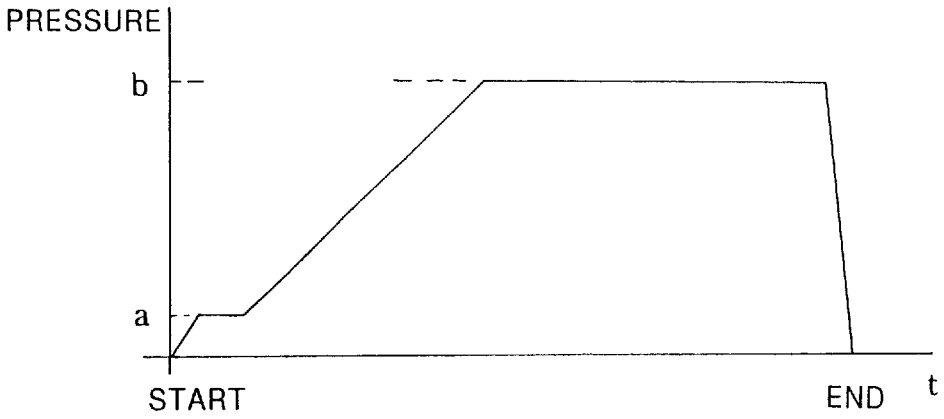
FIG. 4 is a graph showing change of pressure in a first method.

A first method of the present invention will be explained with reference to FIG. 4. First, a first abrading process is performed by: adjusting the pressure in the cylinder chamber 16*a* of the cylinder unit 16; and applying first pressure "a", e.g., 20–30 g/cm$^2$, to the work pieces 25 without applying the full weight of the upper abrasive plate 14 to the work pieces 25. Namely, the "low pressure abrasion" is performed. The pressure applied to the work pieces 25 is gradually increased until reaching the first pressure "a". The first abrading process is performed to abrade and remove fine projections of the work pieces 25. Therefore, a large force is not suddenly applied to the work pieces 25.

After the first abrading process is completed, the pressure in the chamber 16*a* is readjusted, and a second pressure "b", e.g., 100–120 g/cm$^2$, which is higher than the first pressure "a", is applied to the work pieces 25 via the upper abrasive plate 14 without applying the full weight of the upper abrasive plate 14. This process is a second abrading process. The work pieces 25 are finished by the second abrading process.

The pressure is also gradually increased from the first pressure "a" to the second pressure "b". Since the pressure in the chamber 16*a* is increased to apply the proper pressure, which is less than the full weight of the upper abrasive plate 14, to the work pieces 25, the weight of the upper abrasive plate 14 is greater than that of the conventional upper abrasive plate.

By performing the "low pressure abrasion" described above, the pressure can be maintained or fixed by adjusting the air pressure in the chamber 16*a* even if the upper abrasive plate 14 is abraded and its weight is reduced.

Therefore, the lapping machine 10 can always uniformly abrade the work pieces 25 without sharply changing abrading conditions, e.g., the abrading time.

The adjustment of the air pressure in the chamber 16*a*, which is required when the upper abrasive plate 14 is abraded, will be explained later.

Figure 5:
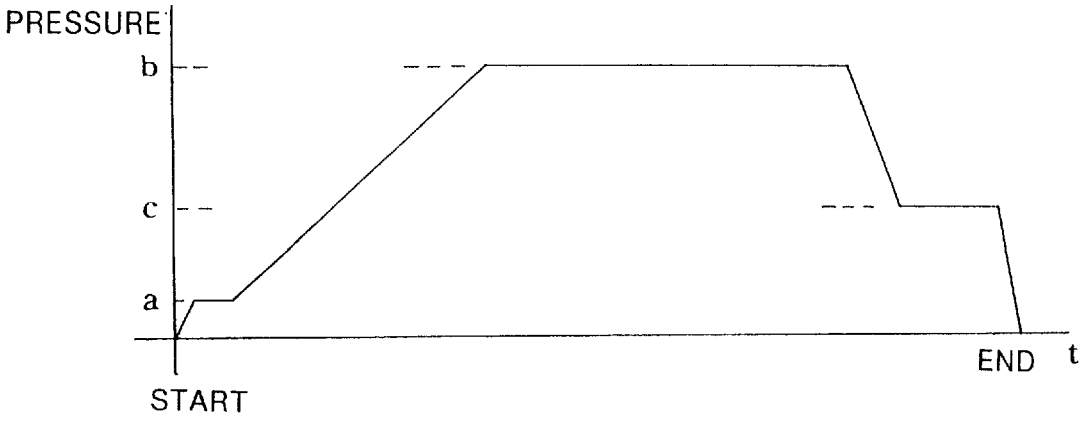
FIG. 5 is a graph showing change of pressure in a second method.

A second method of the present invention will be explained with reference to FIG. 5. In the second method, the first abrading process and the second abrading process, in which the work pieces 25 are not finished, of the first method are performed, then a third abrading process is performed. In the third abrading process, the pressure in the chamber 16*a* is readjusted, and a third pressure "c", e.g., 60–90 g/cm$^2$, which is lower than the second pressure "b", is applied to the work pieces 25 via the upper abrasive plate 14 without applying the full weight of the upper abrasive plate 14. In the second method, the work pieces 25 are finished by the third abrading process.

Since the work pieces 25 are finished with the third pressure "c" lower than the second pressure "b", both faces of the work pieces 25 can be polished well like mirrors.

In the second method, the second pressure "b" may be greater than the preferred pressure, e.g., 100–120 g/cm$^2$, in order to increase abrasive rate, then the work pieces 25 may be finished the third abrading process. By increasing the abrasive rate, the time for abrading the work pieces 25 can be shortened. In this case, the "low pressure abrasion" is also performed from the first abrading process to the third abrading process.

Successively, the abrasion of the upper abrasive plate 14 and the adjustment of the pressure will be explained.

The following formula "Formula 1" is given about the upper abrasive plate 14 and the cylinder unit 16 suspending the upper abrasive plate 14.

$$W=-A\ P+B$$

wherein, "B" is actual weight of the upper abrasive plate; "P" is total pressure of the cylinder chamber of the cylinder unit (area x pressure); "A" is a proportional constant relating to frictional loss, etc. (Actually, the value "A" is slightly varied, but it is considered as a constant value here.); and "W" is actual load applied from the upper abrasive plate (total load applied to whole faces of the work pieces).

The load, weight and pressure toward the work pieces 25 are assigned the plus (+) sign; the load, weight and pressure toward the opposite direction are assigned the minus (–) sign.

The steps of the present method will be explained.

(1) First, the constant value "A" is defined.

The known weight of the upper abrasive weight is considered as "B1". The value "B1" may be initially known weight or actually measured weight. Generally the initially known weight is used.

The value "W1" of the upper abrasive plate 14, to which an optional load is applied, is measured by a load indicator, and the total pressure "P1" of the cylinder chamber 16*a* is simultaneously measured by the pressure sensor 30. The constant value "A" is calculated on the basis of Formula 1 and the measured data. Namely, "A=(B1–W1)/P1".

(2) Actual load from the upper abrasive plate 14 during the first, second and third abrading process, which has been optionally set, is considered as "W2". A value "P2", which satisfies a formula "W2=–A·P2+B1", is calculated. The pressure in the cylinder chamber 16*a* is continuously monitored to adjust the total pressure in the cylinder chamber 16*a* to the value "P2" during the first, second and third abrading process. The air pressure in the chamber 16*a* is always monitored by the pressure sensor 30, and the measured data are inputted to the sequencer 31 The sequencer 31 detects difference between the data and an object value which has been previously inputted. The sequencer 31 controls the pressure control valve 28 to reduce the difference to zero so that the pressure in the chamber 16*a* can be maintained at "P2". This feedback control correctly controls the pressure in the chamber 16*a*.

The abrasive work for a prescribed time, e.g., one day, is performed as described above. The upper abrasive plate 14 is gradually abraded and its weight is also gradually reduced. In the present embodiment, the weight reduced is ignored.

(3) Next time, e.g., the next day, the upper abrasive plate 14 and the pressure in the chamber 16*a* are balanced to abrade the work pieces 25 a prescribed amount.

First, the control valve 28 is closed and the upper abrasive plate 14 is freely suspended. At that time, the pressure "$P_x$" in the chamber 16*a* is measured by the pressure sensor 30. The value "$P_x$" will be gradually reduced with the abrasion of the upper abrasive plate 14.

When the upper abrasive plate 14 and the pressure in the chamber 16*a* are balanced, the actual load from the upper abrasive plate 14 is zero ("W"=0). Therefore, "B1=A·$P_x$" and the value "B1" is replaced with the value "$P_x$" in the formula. At the beginning, the value "A $P_x$" is less than the value "B1".

The actual load from the upper abrasive plate 14 during the first, second and third abrading process, which has been optionally set, is considered as "W3". Actually, the value "W3" is equal to the value "W2". In this state, a value "P3", which satisfies a formula "W3=–A P3+A $P_x$", is calculated. The pressure in the cylinder chamber 16*a* is continuously monitored to adjust the total pressure in the cylinder chamber 16*a* to the value "P3" during the first, second and third abrading process. The sequencer 31 feedback-controls to maintain the pressure in the chamber 16*a* at "P3" as well.

(4) In the abrasive work of following times or days, the value "B1" is replaced with the value "A·$P_x$" every time as described in the item (3). The upper abrasive plate 14 is gradually abraded in and its weight is also gradually reduced in the future, but the amount of abrasion of the upper abrasive plate 14 is very small. Therefore, the weight reduced can be ignored.

In the present method, the work pieces can be always abraded with the fixed pressure, which has been set. Therefore the work pieces can be uniformly abraded, and quality of products can be maintained.

Adjustment of the pressure of the cylinder unit may be performed once for a predetermined number of operations or a predetermined time, e.g., one day. Therefore, the abrasive conditions can be set easier.

Figure 6:
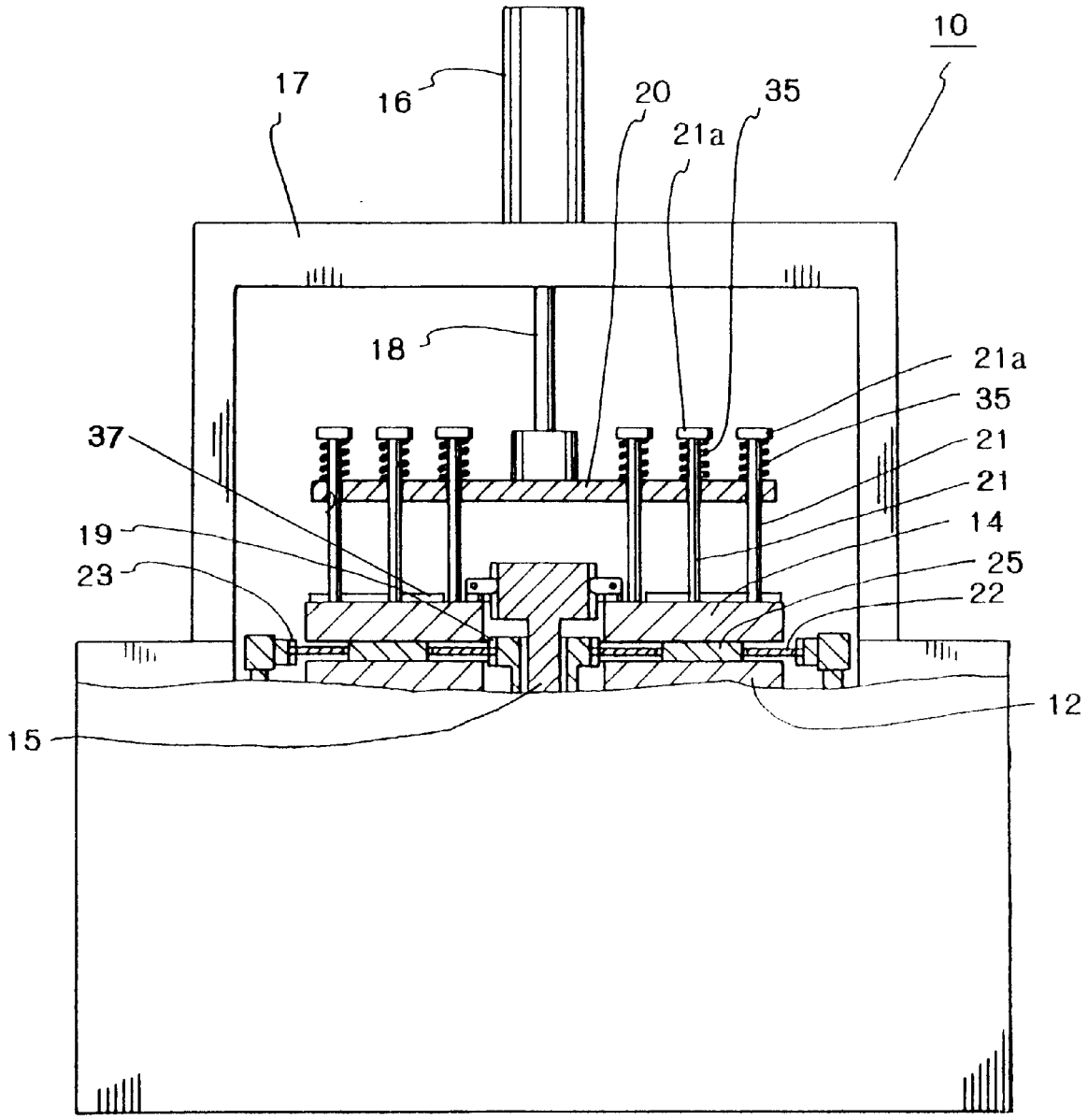
FIG. 6 is a partially cutaway view of another lapping machine in accordance with the invention.

In the above described embodiment, the connecting rods 21 are fixed to the holding disk. However, in another embodiment shown in FIG. 6, the connecting rods 21 are pierced through the holding disk 20 and capable of moving in the vertical direction. Elastic members, e.g., coil springs 35, are respectively provided between stopper sections 21*a* of the connecting rods 21 and the holding disk 20. By providing the elastic members 35, the load is gradually applied to the work pieces 25 from the upper abrasive plate 14. Therefore, damaging and breaking the work pieces 25.can be effectively prevented.

Figure 2:
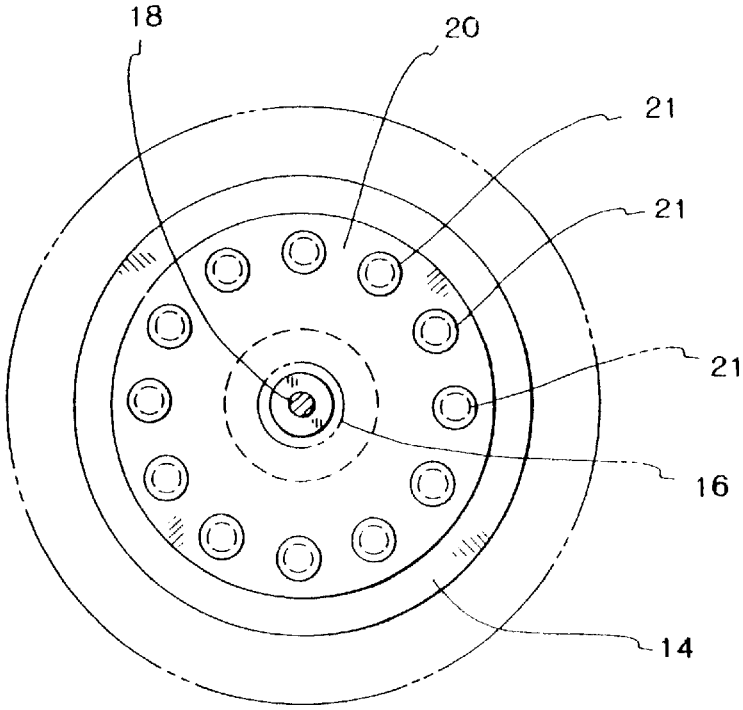
FIG. 2 is a plan view showing arrangement of connecting rods.

The arrangement of the connecting rods 21 is not limited to the example shown in FIG. 2.

In the above described embodiments, a plurality of the rods 21 are connected to the upper abrasive plate 14 so as not to deform the upper abrasive plate 14. The deformation of the upper abrasive plate 14 may be prevented by reinforcing ribs 37, which are provided on an upper face of the upper abrasive plate 14 to increase the rigidity thereof. For example, the reinforcing ribs may be formed in the radial directions or formed like a lattice. The reinforcing ribs can prevent the deformation of the upper abrasive plate 14.

To increase the rigidity of the upper abrasive plate 14 and prevent the deformation thereof, a heavy and thick upper abrasive plate may be used. In the present invention, the "low pressure abrasion" is performed throughout the abrasive work so the fixed load can be always applied to the work pieces. Therefore, the work pieces can be uniformly abraded every time, and the abrasive conditions can be set easily.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method for abrading both faces of a work piece in an abrasive machine including:

a rotatable lower abrasive plate;

a rotatable upper abrasive plate being provided to face said lower abrasive plate so as to clamp the work piece with said lower abrasive plate;

a cylinder unit having pressure chamber and a rod from which said upper abrasive plate is suspended, said cylinder unit moving said upper abrasive plate in a vertical direction; and said method comprising:

varying the pressure in said pressure chamber to provide different pressures for different abrading process, said step of varying the pressure in said pressure chamber comprising the steps of:

adjusting the pressure of said pressure chamber of said cylinder unit in a first abrading process so as to apply a first pressure to the work piece via said upper abrasive plate without applying the full weight of said upper abrasive plate; and readjusting the pressure of said pressure chamber in a second abrading process so as to apply a second pressure which is higher than the first pressure to the work piece via said upper abrasive plate without applying the full weight of said upper abrasive plate.

2. The method according to claim 1, wherein the step of varying the pressure in said pressure chamber further comprises the step of readjusting the pressure of said pressure chamber in a third abrading process so as to apply a third pressure which is lower than the second pressure to the work piece via said upper abrasive plate.

3. The method according to claim 1, further comprising arranging a reinforcing rib on an upper face of said upper abrasive plate so as to increase rigidity of said upper abrasive plate.

4. The method according to claim 1, further comprising fixing a holding disk to the rod of said cylinder unit, coupling a plurality of connecting rods to said holding disk, and fixing said upper abrasive plate to said connecting rods.

5. The method according to claim 1, wherein said first abrading process and said second abrading process comprise the steps of:

calculating a constant "A", on the basis of:

a formula "W=−A·P+B" (wherein B is weight of said upper abrasive plate, P is total pressure of said pressure chamber of said cylinder unit, A is a proportional constant relating to frictional loss, W is actual load applied from said upper abrasive plate);

a known weight "B1" of said upper abrasive plate;

a measured actual load "W1" applied from said upper abrasive plate when an optional load is applied to said upper abrasive plate; and a measured total pressure "P1" of said pressure chamber;

calculating a value "P2" which satisfies a formula "W2=−A·P2+B1" (wherein W2 is a set actual load applied from said upper abrasive plate while abrading);

monitoring the pressure in said pressure chamber; and adjusting the total pressure in said pressure chamber to the value "P2", and wherein said first abrading process and said second abrading process of a subsequent abrading of another work piece comprise the steps of:

calculating a value "B1" (=A·PX) of a balanced state on the basis of the value "W"(=0) and a measured total pressure "PX" of said pressure chamber;

replacing the value "B1" with the value "PX"; and calculating a value P3 which satisfies a formula of "W3=−A·P3+B1" (wherein W3 is a set actual load applied from said upper abrasive plate while abrading);

monitoring the pressure in said pressure chamber; and adjusting the total pressure in said pressure chamber to the value "P3".

6. The method according to claim 1, wherein said abrasive machine has a mechanism for applying pressure to said pressure chamber of said cylinder unit; and said mechanism comprises:

a pressure source;

a pressure control valve provided between said pressure source and said pressure chamber of said cylinder unit;

a pressure sensor for measuring the pressure of said pressure chamber of said cylinder unit; and a sequencer for controlling valve opening of said pressure control valve based on the pressure measured by said pressure sensor.

7. The method according to claim 1, wherein the step of varying the pressure in said pressure chamber further comprises the steps of:

arranging a pressure control valve between a pressure source and said pressure chamber of said cylinder unit;

measuring the pressure of said pressure chamber of said cylinder unit; and controlling said pressure control valve based on the pressure measured by said pressure sensor to thereby increase or decrease in the pressure in said pressure chamber.

8. The method according to claim 7, wherein the step of varying the pressure in said pressure chamber further comprises the step of directing the measured pressure of said-pressure chamber of said cylinder unit to a sequencer, said pressure control valve being controlled by said sequencer.

9. The method according to claim 1, further comprising the step of arranging an additional chamber in said cylinder unit on an opposite side of said rod, said additional chamber communicating with surrounding air.

10. The method according to claim 1, wherein the step of varying the pressure in said pressure chamber further comprises the steps of:

connecting a pipe between said pressure chamber of said cylinder unit and a pressure source;

arranging a pressure control valve in connection with said pipe;

measuring the pressure of said pressure chamber of said cylinder unit by measuring pressure in said pipe proximate said pressure chamber; and controlling said pressure control valve based on the pressure measured by said pressure sensor to thereby increase or decrease in the pressure in said pressure chamber.

11. The method according to claim 1, further comprising fixing a holding disk to the rod of said cylinder unit, coupling a plurality of connecting rods to said holding disk, and fixing said upper abrasive plate in engagement with said connecting rods.

* * * * *